US005615506A

United States Patent [19]

Jackson et al.

[11] Patent Number: 5,615,506

[45] Date of Patent: Apr. 1, 1997

[54] CARTRIDGE MAGAZINE FOR FIREARMS

[75] Inventors: Terry R. Jackson, Bozeman; Rory J. Erhard, Belgrade; Robert A. Kinzle, Bozeman; Robert B. Cady, Belgrade, all of Mont.

[73] Assignee: William L. Heckerman, Jackson, Wyo.

[21] Appl. No.: 550,705

[22] Filed: Oct. 31, 1995

[51] Int. Cl.[6] ..... F41A 9/68

[52] U.S. Cl. ..... 42/50; 89/34

[58] Field of Search ..... 42/50, 18, 22, 42/49.02; 89/34

[56] References Cited

U.S. PATENT DOCUMENTS

| | | | |
|---|---|---|---|
| 2,289,067 | 7/1942 | Owsley | 42/50 |
| 2,398,263 | 4/1946 | Trimbach | 89/34 |
| 3,191,332 | 6/1965 | Ardolino | 42/50 |
| 3,623,256 | 11/1971 | Shiplee, III | 42/50 |
| 4,127,954 | 12/1978 | Hausmann | 42/50 |
| 4,447,976 | 5/1984 | Cooper | 42/50 |
| 4,484,403 | 11/1984 | Schwaller | 42/50 |

FOREIGN PATENT DOCUMENTS

| | | | |
|---|---|---|---|
| 1126545 | 9/1968 | United Kingdom | 89/34 |

*Primary Examiner*—Stephen M. Johnson
*Attorney, Agent, or Firm*—Cushman Darby & Cushman IP Group of Pillsbury Madison & Sutro LLP

[57] ABSTRACT

A cartridge magazine for use with a firearm includes a housing arranged to enclose a plurality of cartridges. The housing has an opened end and a mouth for permitting cartridges to be loaded therein and dispensed therefrom. A follower is movably positioned within the housing and biased toward the mouth.

13 Claims, 4 Drawing Sheets

CARTRIDGE MAGAZINE FOR FIREARMS

BACKGROUND OF THE INVENTION

1. Field of the Invention

The present invention relates to cartridge magazines for use with firearms, and more particularly, to an improved way of coupling several magazines together.

2. Background Information

Conventional cartridge magazines include an enclosed housing having an open mouth, for bullet entry and exit at one end thereof, sometimes referred to as a discharge assembly, a follower moveable within the housing and a biasing structure for biasing the follower toward the mouth. Thus, as cartridges lie in contact with the follower, they are continuously biased toward the mouth.

Magazines of this type are generally known in the art. One such magazine is described in Hausmann, U.S. Pat. No. 4,127,954, the disclosure of which is hereby incorporated by reference into the present specification. This magazine includes an upper end receiver and discharge assembly, a housing in which a follower is positioned for sliding movement. The follower guides cartridges as they are inserted into the magazine and provides suitable force against the cartridges loaded in the magazine to assist in cartridge discharge into the breech of a weapon.

A number of approaches have been suggested for connecting several magazines together. One example is incorporated in the Hausmann style magazine. On one side wall there exists a cylindrical hole and a protruding cylindrical stud so that two magazines can be joined together by inverting one magazine relative to the other, thereby aligning each of the studs over a respective hole. By then pushing each of the studs into a respective and aligned hole, the magazines will be held together in their respectively inverted positions. In that configuration one mouth will face downwardly, the other upwardly.

Another example is shown in Owsley, U.S. Pat. No. 2,289,067, where two box type metal magazines are formed into a unitary structure by spot-welding the rear walls of two magazines at several spaced locations.

Ardolino, U.S. Pat. No. 3,191,332, which also relates to metal box type magazines, shows another approach in which two magazines are connected in an end-to-end fashion. Each magazine includes a sliding lock plate adjacent one side of each end and a ball-type stud adjacent the other side of each end. By rotating one of the magazines 180degrees each ball-type stud can be received in an opening in each lock plate designed to capture and hold the ball-type stud located on another magazine.

Both the Owsley and Ardolino structures resulting turned 180 degrees during use when changing from one magazine to another. Schwaller, U.S. Pat. No. 4,484,403, suggested connecting several magazines in a side-by-side orientation so that each was directed in the same direction. This was accomplished by including on one side wall two spaced apart female coupling parts and two spaced male coupling parts on the opposite side wall. Each female part included a slot with the bottom one being rotated 90 degrees from the top one. Each male part included a headed pin that could be slid into the appropriate slot. However, the mouth of each magazine was very close to the other making use difficult.

Cooper, U.S. Pat. No. 4,447,976 suggested mounting several small magazines on the exterior surfaces of a separate mounting base member so that each magazine would face outwardly for use. The mounting base would provide the ability to mount two or four magazines.

Shiplee, U.S. Pat. No. 3,623,256, coupled several magazines together by use of a separate holder into which standard box-type magazines would be received.

None of these prior art devices, however, provide a magazine structure that permits a variety of coupled orientations directly with other like magazines, nor do they provide a truly compact multiple magazine configuration.

SUMMARY OF THE INVENTION

Accordingly, it is the general purpose and object of the present invention to provide a cartridge magazine for firearms which can be easily coupled directly to other like magazines.

Another object is to provide a magazine that can be arranged in a variety of orientations so that use of each of the coupled configurations will not interfere with shooting, allow ease of handling and yet permit the user to have ready access to other magazines. It also permits easy storage and a convenient way to package multiple magazines directly to one another in a manner that permits loading, reloading, and immediate use all while in a coupled configuration.

It is also an object to develop a coupling arrangement that will not hit the stock or trigger guard of a firearm yet permit easy insertion into a weapon receiver area and be easily released therefrom.

In accordance with the principles of the present invention, these objects are achieved by providing the magazine with a built-in housing connection system that will allow a user to clip together two, three or four magazines directly to other like magazines. Each magazine includes a rear face and an end wall that are provided with a separate coupling arrangement designed to interact and interfit with a like mating coupling arrangement on another magazine. Collectively, these coupling arrangements on a series of cartridge magazines comprise a connection system permitting two, three or four such magazines to be connected together, into a fairly rigid yet releasable system, for use, storage, shipment or other related purposes.

Other objects, features and characteristics of the present invention, as well as the methods of operation and functions of the related elements of the structure, and the combination of parts and economies of manufacture, will become more apparent upon consideration of the following detailed description and appended claims with reference to the accompanying drawings, all of which form a part of the specification.

DETAILED DESCRIPTION OF THE PREFERRED EMBODIMENT

Figure 1:
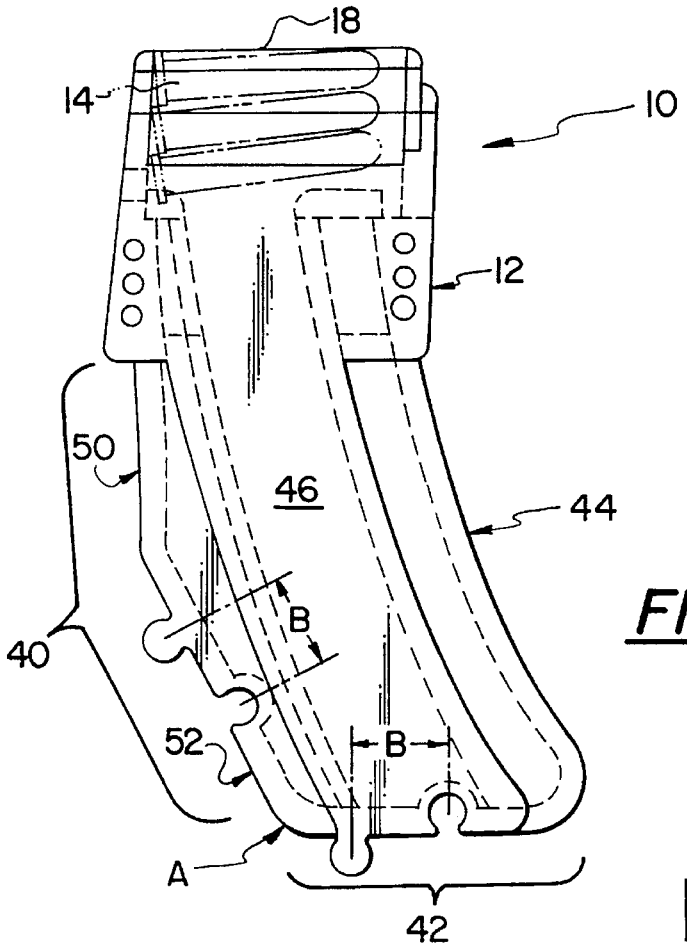
FIG. 1 is a schematic side elevational view of a cartridge magazine according to the present invention.

A magazine in accordance with the present invention for holding cartridges for use with a firearm is shown in FIGS. 1 through 4 generally at 10. As shown in FIG. 1, the magazine 10 comprises a housing 12 constructed and arranged to enclose a hollow interior for retaining a plurality of cartridges 14. Housing 12 is preferably molded in the form of two lateral halves from a relatively rigid plastic, such as, for example, polycarbonate, or other thermoplastic or a thermoset materials. It should be understood that housing 12 could also be formed of a metal material. A completed housing 12 is then formed by attaching the two molded halves together such as by heat sealing, adhesives, sonic welding or other similar approaches. Housing 12 has an upper opened end or mouth 16 which can be defined, for example, by a separately molded retainer 18 housed therein. The mouth 16 is configured such that a cartridge 14 is permitted to be passed there through, against the force of a follower 20 slidably received within the interior of the housing 12, into the interior and also to permit a cartridge to be dispensed therefrom. This upper end can be formed to have a variety of configurations, each being designed to interfit with specific magazine receivers as are used by specific firearms. As noted previously, this upper end can be called a discharge assembly.

Housing 12 can have a generally arcuate shape in plan form to conform, for example internally, to a stacking arc developed by a plurality of rimmed cartridges 14 housed therein. However, housing 12 could also be straight to accommodate rimless cartridges or with the follower and the internal housing structure being shaped to accommodate the arc associated with the rimmed cartridges, for example, as disclosed in U.S. Pat. No. 5,113,604, the disclosure of which is hereby incorporated by reference into the present specification.

Figure 2:
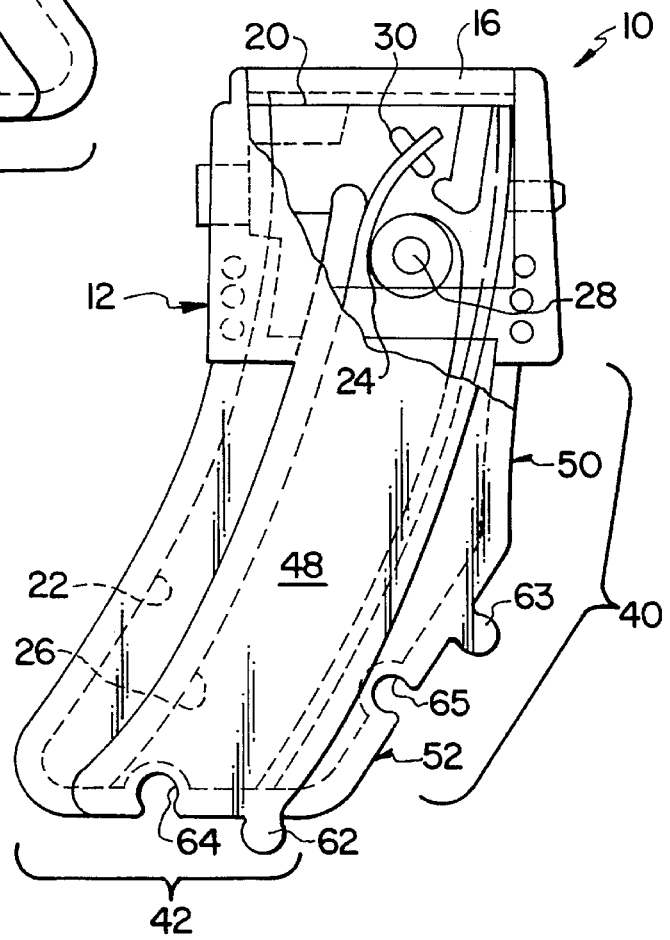
FIG. 2 is a vertical sectional view of the cartridge magazine of FIG. 1, a portion of which has been cut away for clarity.

As shown in FIG. 2, housing 12 is constructed and arranged to define an interior groove 22. Follower 20 is slidably received within groove 22 and is held in a biased home or up position, as shown in FIG. 1, by a coil spring 24. Spring 24 advances the follower 20 toward the mouth 16 of the cartridge magazine 10. When follower 20 is slid toward the bottom of the magazine, the coil spring 24 will move within another interior groove 26 formed in and defining part of one of the housing side walls. The movement of follower 20 can also be controlled by a guide pin 28 which also moves within the groove 26 and on which the coil spring 24 is mounted and about which it will wind and unwind as required by the movement of follower 20. The spirally wound spring 24 is secured at its free end thereof to the upper end of the housing 12 and specifically to a pin 30 that is itself molded within housing 12. The housing 12, follower 20, and spring 24 are of the type generally disclosed in U.S. Pat. No. 4,127,954, previously referenced.

It should be appreciated that housing 12 can be of any configuration suitable for enclosing a plurality of cartridges 14. Further, although in the illustrated embodiment, the biasing structure is a spirally wound spring 24, other approaches may be used to bias follower 20. For example, coil springs, compression springs, leaf springs or other springs constructed and arranged to bias the follower 20 may be used.

In accordance with the invention, the completed housing 12 as in FIG. 1 has a rear wall, generally indicated at 40, an end or bottom wall generally shown at 42, a front wall 44 and opposing side walls 46 and 48. Rear wall 40 includes an upper portion, generally shown at 50, and a lower portion, generally shown at 52, which are positioned so that between them they define an included angle of about 150 to 160 degrees, preferably about 155 degrees. End wall 42 and the lower rear wall portion 52 are to be positioned at an angle relative to each other so as to define an included angle of 120 degrees.

In addition, the top of mouth 16 is defined by a generally straight edge that is preferably positioned to be substantially parallel with end wall 42.

Figure 5:
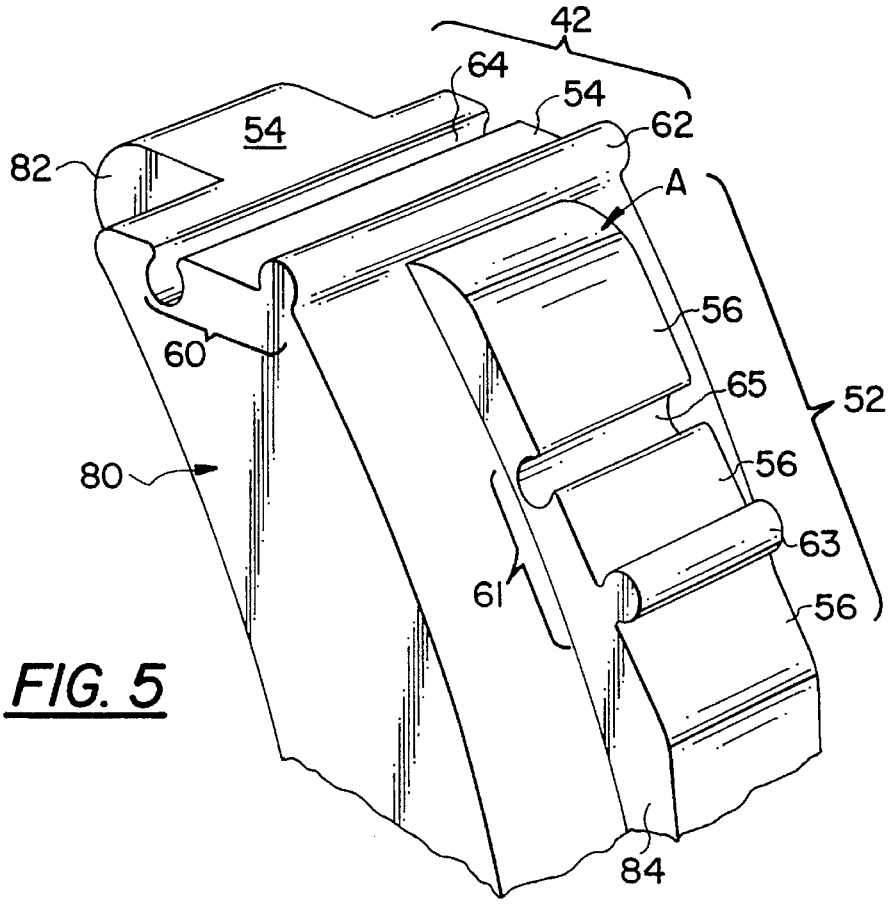
FIG. 5 is an enlarged partial perspective view of the coupling mechanism.

With reference to FIG. 5, end wall 42 is provided with flat bottom surface areas 54 on opposite sides of a transversely extending groove 64. Similarly, the lower rear wall portion 52 is also provided with flat surface areas 56 that lie on opposite sides of a transverse groove 65.

The lower rear wall portion 52 and the end wall 42 each include a coupling mechanism, generally indicated at 60 and 61, respectively. Coupling mechanism 60 includes an elongated transversely extending rod type projection 62 and groove 64 mentioned above. Coupling mechanism 61 includes a similar transversely extending rod 63 and groove 65. Both rod type projections 62 and 63 and each groove 64 and 65 extend across the width of the magazine at the point where they are positioned. As shown in FIG. 5, there is a full width portion of the housing at 80, and narrower width portions 82 and 84 where the housing defines interior grooves or channels. Projections 62 and 63 are sized or dimensioned in a manner that will permit either projection 62 or 63, on another magazine, to be slidably received within either groove 64 or 65 and from either end of the groove.

As can be observed in FIGS. 2 and 5 the projections 62 and 63 have a slightly enlarged headed portion and a slightly undercut lower area closer to the housing. Likewise, grooves 64 and 65 are slightly under cut interiorly so that, for example, when projection 62 is positioned within groove 64 it will be retained vertically yet be slidable therein. If desired, one or both of the projection or the groove can be provided with a stop, to limit the relative sliding motion therebetween. As another alternative, small detents could be included to hold the two members in a desired interfitting relationship. Alternatively, a simple friction fit, for example, by having a slightly enlarged middle area along projections 62 and 63, could be sufficient to hold the coupled magazines together.

The flat areas 54 and 56 provide additional stability to the resulting joints since these flat areas will be directly juxtaposed when like magazines are mounted together in a coupled configuration. The interengagement of such flat areas helps stabilize the joint so that the two coupled magazines will not twist relative to each other. The flat areas also assist the sliding connection being formed. If desired, positioning detents could be provided on the flat areas so that two magazines would, in effect, snap together at a desired position.

With reference still to FIGS. 2 and 5, the corner defined between the lower rear wall portion 52 and end wall 42 has been designated with the letter "A". A distance, designated at "B", as shown in FIG. 1, corresponds to the dimension between the center lines of projections 62 and 63 and grooves 64 and 65, respectively. Dimension "B" will be the same for all mating magazines and will typically be about 0.45 inches.

Typical dimensions for housing 10, that can hold up to ten cartridges, is an overall height from the mouth 16 to the bottom of end projection 62 is about 3.75 inches (about 9.5 cm), while the thickness between side walls 46/48 of about 1.25 inches (about 3 cm). The upper housing has a width of about 1.5 inches (about 3.75 cm) and the width of the internal area traversed by follower is about 1.2 inches (about 3.1 cm) for a follower length of about 1 inch (about 2.54 cm).

Figure 3:
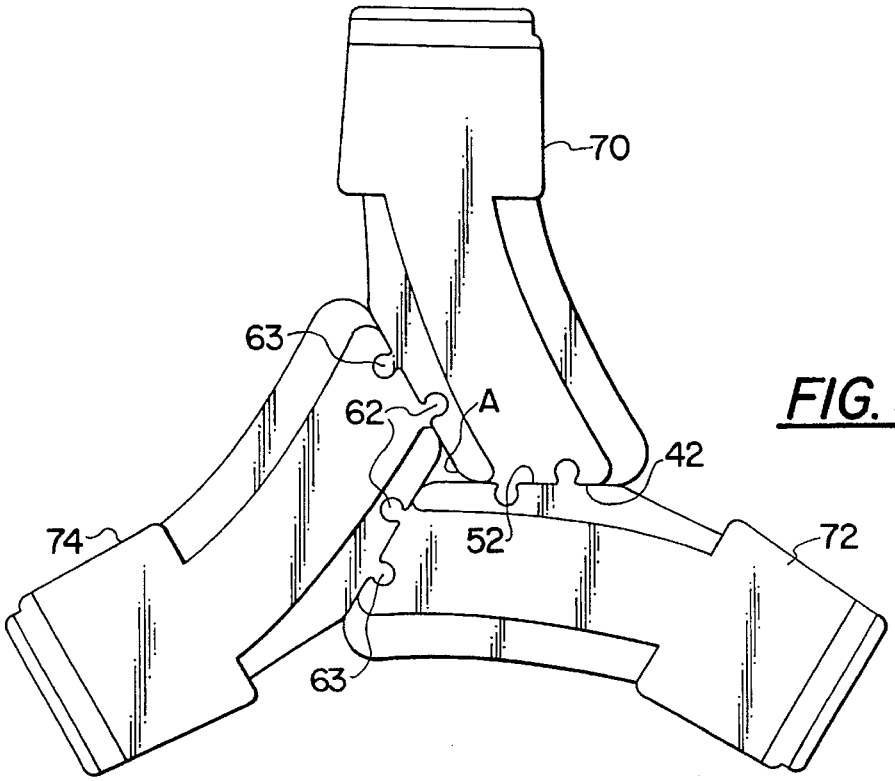
FIG. 3 is a side elevational view of three cartridge magazines of FIG. 1 coupled together.

FIG. 3 shows three magazines 70, 72 and 74 being coupled in a star type configuration where each respective end wall 42 is directly coupled to a respective lower rear wall 52. This demonstrates the coupled configuration of projections 62 and 63 within respective grooves 64 and 65. This coupled configuration or relationship provides a very compact and sturdy arrangement, especially since each of the lower rear wall 52 and end wall 42 are connected together with mating flat areas 54 and 56 being in direct contact. The presence of such flat areas provides a stable base that supports the coupled joint, they prevent the joined area from twisting and help to maintain a rigid connection between magazines. This coupled configuration provides maximum clearance between the upper ends of each magazine, yet positions point "A" of each magazine close together.

Figure 4:
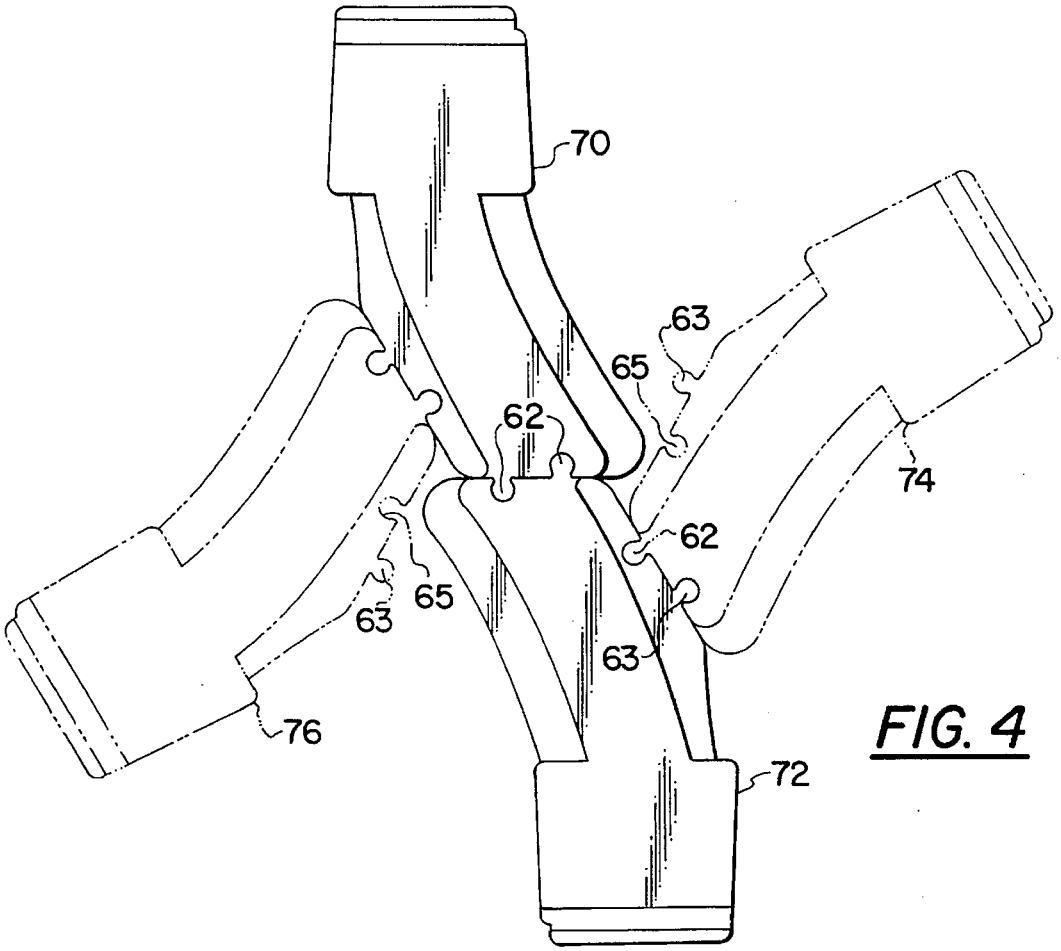
FIG. 4 is a side elevational view of two and four cartridge magazines of FIG. 1 coupled together.

FIG. 4 shows two different configurations in which the same magazines of the present invention can be coupled. The full line portion of the drawing shows two magazines, 70 and 72, respectively, connected together in an end-to-end relationship, where the end walls 42 are coupled together. Two other magazines 74 and 76, shown in phantom, are connected in an end wall-to-rear wall configuration. The two full line magazines 70 and 72 have been turned so that their rear walls 52, respectively, face in opposite directions. However, because the spacing between each projection 62 and groove 64 on their respective end walls 42 are substantially identical, magazines 70 and 72 could also be coupled with their rear walls 52 facing in the same direction.

Figure 6:
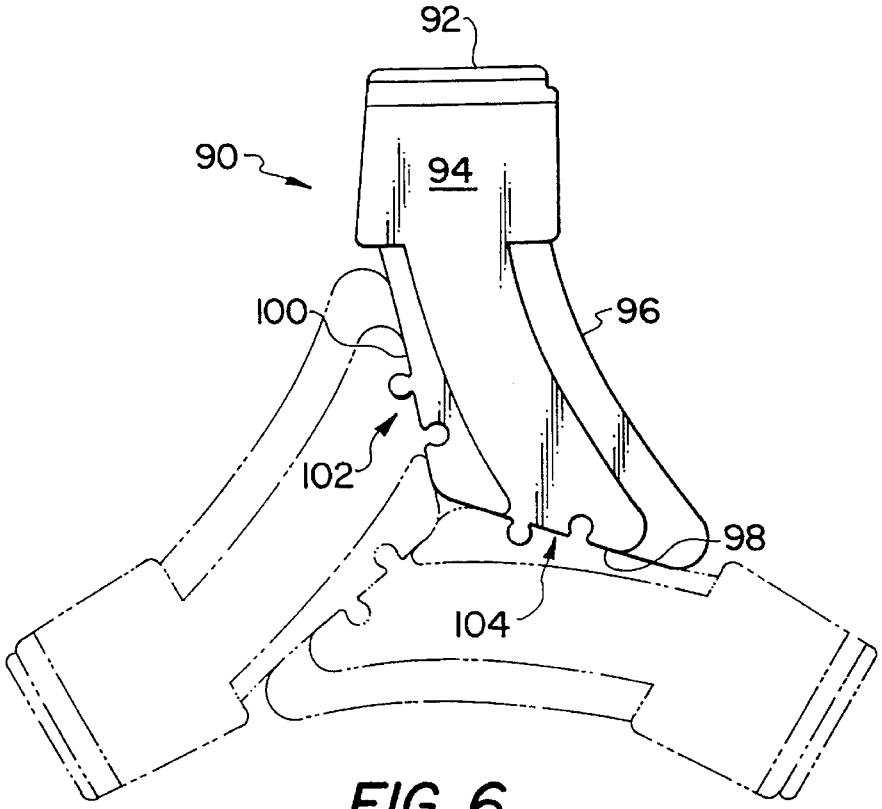
FIG. 6 is a side elevational view of a second embodiment of a cartridge magazine and a coupled configuration.
Figure 7:
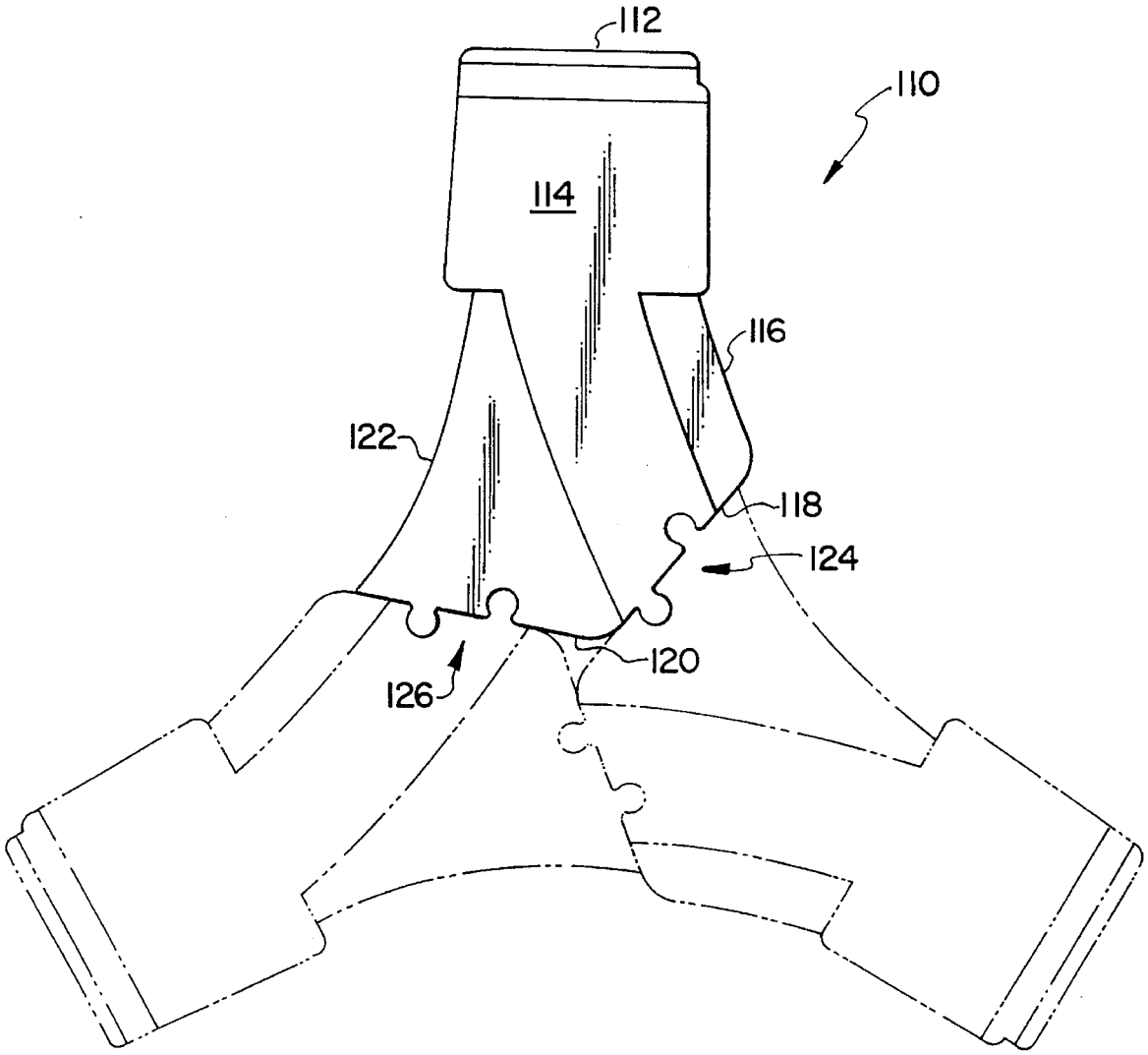
FIG. 7 is a side elevational view of a third embodiment of a cartridge magazine and a coupled configuration.

FIGS. 6 and 7 show two additional magazine designs and coupled configurations.

In FIG. 6, the magazine, generally shown at 90, includes a mouth 92 at the top, sidewalls, one which is shown at 94, a front face or wall 96, a bottom or end wall 98 and a rear wall 100. The angle between the top of mouth 92 and end wall 98 is about 18° so that there is no parallel relationship between those portions of magazine 90. The included angle between end wall 98 and rear wall 100 is 120°, so that three magazines can be mounted in a star-shaped configuration as shown by use of the mounting arrangements 102 on rear wall 100 and 104 on end wall 98. These mounting arrangements are the same as were discussed previously regarding the projection and groove elements, 62/64 and 63/65 on the end and rear walls, respectively, in FIGS. 2 and 5. This magazine design permits manufacture of the smallest outer envelope for a ten round magazine that is still mountable with other like magazines.

FIG. 7 shows another magazine design that comprises a much larger outer envelope. Here again magazine 110 includes a mouth 112, side walls 114, a front wall 116, an end wall 118, a bottom wall 120 and a rear wall 122. It should be noted that in this magazine bottom wall 120 and rear wall 122 are two distinct wall surfaces. Also, the mounting walls are end wall 118 and bottom wall 120, that respectively include mounting arrangements 124 and 126, respectively. Each of these mounting arrangements 124 and 126 are again the same as were discussed previously regarding the projection and groove elements, 62/64 and 63/65 on the end and rear walls, respectively, in FIGS. 2 and 5. Further, mouth 112 is not parallel with end wall 124 but rather lies at an angle of about 50° relative to end wall 118.

The included angle between end wall 118 and bottom wall 120 is 120°. Accordingly, three of the 110 style magazines can be coupled into the star shaped configuration shown in FIG. 7.

It should also be understood that two of the magazine shapes, as in FIGS. 6 and 7, can be mounted together.

While the invention has been described in connection with what is considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A cartridge magazine for use with a firearm comprising:

a housing arranged to enclose a plurality of cartridges, said housing having an opened end defining a mouth for permitting cartridges to be loaded therein and dispensed therefrom;

a follower movably positioned within said housing and biased toward said mouth; and said housing having a pair of adjacent outer walls each of which is provided with a magazine coupling assembly.

2. A cartridge magazine as in claim 1 wherein the pair of adjacent outer walls comprises an end wall and an adjacent side wall.

3. A cartridge magazine as in claim 2 wherein said adjacent side wall comprises a rear wall.

4. A cartridge magazine as in claim 1 wherein said coupling assembly on each of said pair of adjacent outer walls is substantially identical.

5. A cartridge magazine as in claim 1 wherein said coupling assembly comprises an outwardly extending projection and a corresponding mating groove.

6. A cartridge magazine as in claim 1 wherein said coupling assembly on one outer wall of said magazine slidably interfits with a like coupling assembly on another outer wall of another magazine.

7. A cartridge magazine as in claim 2 wherein the angle between said end wall and said side wall is 120°.

8. A cartridge magazine as in claim 1 wherein the housing is molded from a plastic material.

9. A cartridge magazine as in claim 2 wherein the coupling mechanism is integrally molded to said end wall and said side wall.

10. A multi-round magazine having an upper portion formed to interfit into a receiver, and a lower portion having a pair of opposing side walls interconnected by opposing front and rear walls and a bottom end wall, said rear wall and said bottom end wall each having adjacent flat wall portions, said flat wall portions including substantially identical mating members integrally formed therein.

11. An ammunition magazine comprising:

a housing;

a receiver and discharge assembly at one end of said housing;

said housing further including a plurality of exterior walls;

a coupling assembly provided on two adjoining ones of said plurality of exterior walls for interfitting with at least one mating coupling assembly on another ammunition magazine.

12. An ammunition magazine as in claim 11 wherein one of said two adjoining ones of said plurality of exterior walls comprises an end wall positioned substantially opposite said receiver and discharge assembly.

13. An ammunition magazine as in claim 11 wherein each said coupling assembly includes identical features.

* * * * *